United States Patent [19]

Hutchinson

[11] 4,356,991

[45] Nov. 2, 1982

[54] PORTABLE BOARD FOR STUDY, WRITING AND READING

[76] Inventor: Robert B. Hutchinson, Box 938, 710 County Rd., Pocasset, Mass. 02559

[21] Appl. No.: 170,455

[22] Filed: Jul. 21, 1980

[51] Int. Cl.[3] ..... A47B 23/00

[52] U.S. Cl. ..... 248/463; 248/444

[58] Field of Search ..... 248/444, 455, 456, 457, 248/463, 439; 403/145, 146; 168/43, 122, 130, 132

[56] References Cited

U.S. PATENT DOCUMENTS

| | | | |
|---|---|---|---|
| 241,512 | 5/1881 | Ritter | 248/463 X |
| 838,516 | 12/1906 | Bodinger | 248/463 X |
| 963,327 | 7/1910 | Schmitt | 248/463 |
| 1,258,120 | 3/1918 | Kaplan | 248/456 |
| 1,671,231 | 5/1928 | Culbertson | 248/445 |
| 2,478,849 | 8/1949 | Thompson | 248/444 |
| 2,640,747 | 6/1953 | Bodenhoff | 248/444 |
| 2,828,985 | 4/1958 | Ridenour | 403/145 |

FOREIGN PATENT DOCUMENTS

| | | | |
|---|---|---|---|
| 2036603 | 2/1972 | Fed. Rep. of Germany | 108/132 |
| 2381491 | 10/1978 | France | 108/132 |

*Primary Examiner*—William H. Schultz
*Attorney, Agent, or Firm*—Howard I. Podell

[57] ABSTRACT

A portable board for use in studying, writing and reading has a clear side with a ledge in a lower central portion of the side and has a game board marked on an opposite side of the board, a concave lower edge permits positioning the board over the user when the user is reclining on a bed. A bail attached to the sides of the board can be used to hold the board at a sloped angle. A set of mounting plates and positioning plates with sockets and a top center channel is used to secure the bail alternatively in an opened position or in a closed position. A set of corrugated spring metal bushings hold the opposed ends of the bail between the plates.

1 Claim, 9 Drawing Figures

PORTABLE BOARD FOR STUDY, WRITING AND READING

SUMMARY OF THE INVENTION

I have invented a new and novel portable board for study and writing and reading. My device is valuable in colleges and for games inasmuch as the portable board can be held snug to the body when a person is reclining or in a chair. This device can be used in a bed or on a floor and has a ledge on one side of the board to support a book when it is rested on that side of the board. A bail supported by a corrugated spring metal bushing mounted between mounting plates provides a support so that the board may be used as a leaning table for reading purposes.

DESCRIPTION OF THE BACKGROUND

The following patents describe items fitted with a pivoted support member but do not teach the simplicity and effectiveness of the structure of my invention: Great Britain Pat. No. 1,308,593; Great Britain Pat. No. 393,014; U.S. Pat. No. 236,371; U.S. Pat. No. 838,516; U.S. Pat. No. 501,149 U.S. Pat. No. 372,496; U.S. Pat. No. 2,861,854; U.S. Pat. No. 3,147,949; U.S. Pat. No. 3,172,636; U.S. Pat. No. 3,991,966; U.S. Pat. No. 3,821,936; U.S. Pat. No. 3,009,750; U.S. Pat. No. 1,934,271; U.S. Pat. No. 2,973,603; U.S. Pat. No. 1,894,559; U.S. Pat. No. 3,652,051; U.S. Pat. No. 1,613,440.

BRIEF DESCRIPTION OF THE DRAWINGS

The objects and features of the invention may be understood with reference to the following detailed description of an illustrative embodiment of the invention; taken together with the accompanying drawings in which.

DESCRIPTION OF THE PREFERRED EMBODIMENT

Figure 1:
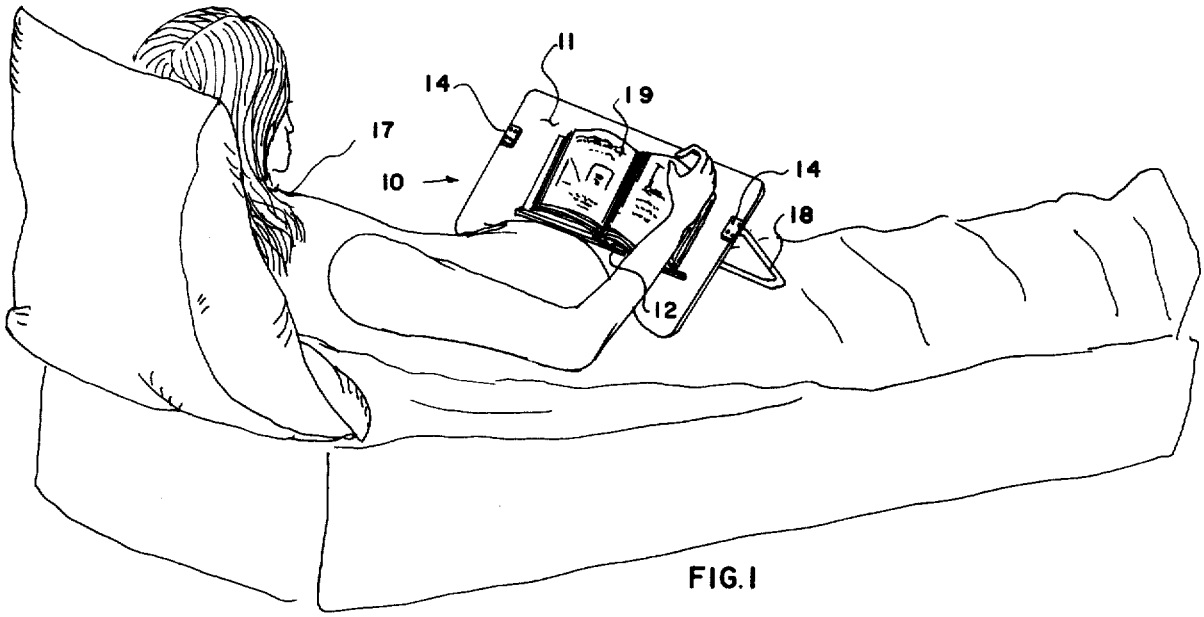
FIG. 1 is a perspective front view of the device in use, in an opened configuration.
Figure 2:
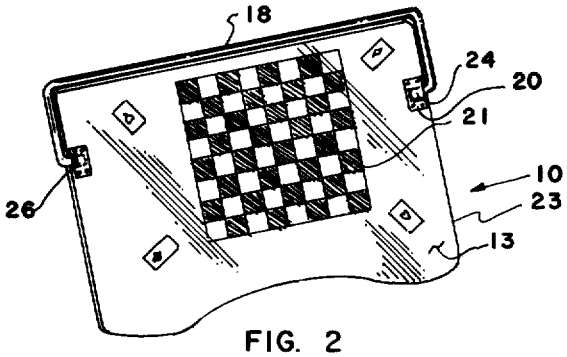
FIG. 2 is a rear view of the device in a closed configuration.

Turning now descriptively to the drawings, in which similar reference characters denote similar elements throughout the several views, FIGS. 1–9 illustrate the invention which is formed of a flat board 10 shaped with a lower concave surface 15 to fit over a person 17 reclining on a bed with a horizontal ledge 12 projecting from the lower portion of the face side 11 of the board for support of a book 19.

The rear face 13 of the board is marked with indicia 21 including that of a chess board.

Front flat hinge plates 14 and shaped rear hinge plates 20, are fitted on opposing side of the board for detachable pivotable retention of a bail 18. All plates project somewhat beyond the opposed side edges 23 of the board, with each plate 20, formed with a curved socket portion 25 that is aligned with a slot 27 extending from each edge 23 of the board in an axial direction generally perpendicular to the respective edge 23. Socket portion 25 extends concavely from the underside of the plate 20, and convexly from the external side of these plates 20. An open slot 21 extends from the outermost portion of each socket portion 25 from the outer edge of each plate 20, the side edge 23 of the board in the fixed position of plates 14, 20 when held together by rivets 30 through holes 22.

Slots 21 are each of a width along the vertical axis of the board, which width is greater than the diameter of the wire of bail 18, with slots 27 each slightly wider than slots 21.

A corrugated spring metal bushing 28 is secured in slot 21 and is of a size to snugly fit within the confines of slot 21 and between the underside of plate 14 and the underside of the socket portion 25 of plate 20. The corrugations 33 of the bushing are of a size to snugly pivotally retain the respective end portion 31 of bail 18 within the interior of the bushing. The bushing 18 is of a C-shaped transverse cross-section so that opposed leg portions 37 may be bent towards or away from each other to provide snug sliding fit adjustment inside of slot 27 and against the end portion 31 of the ball. Preferably the outermost section of the flanges 39 are relieved so that flanges 39 do not extend into the slot section 21 of the plate 20, when installed.

Bail 18 is shaped as a C-shaped member of spring wire and is of a shape so that the opposed end surfaces 41 may be manually temporarily sprung apart by the distance between plate slot edges 43 for insertion or removal of the bail from the device. When installed, however, edges 41 and a section of each end 31 of the bail lies within a bushing 18 within slot 27 of the board, with the corrugations of bushing 18 maintaining spring tension against both end section 31 of the bail and the walls 45 of slot 27 so as to both retain the bail in engagement with the board and to provide spring torque resistance to rotation of the bail so that it will rest at any set inclined position with respect to the board, in both the open or closed position.

Figure 4:
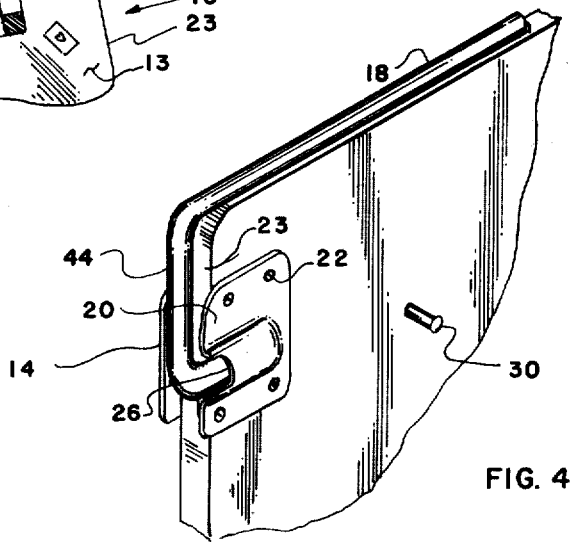
FIG. 4 is a perspective detail view of one edge of the device showing the attachment of the bail to the board.
Figure 3:
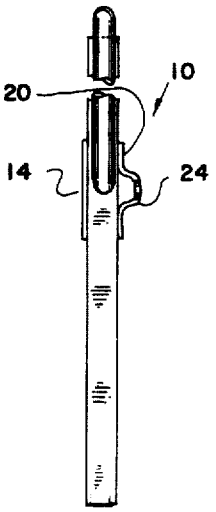
FIG. 3 is a side view of the device.
Figure 5:
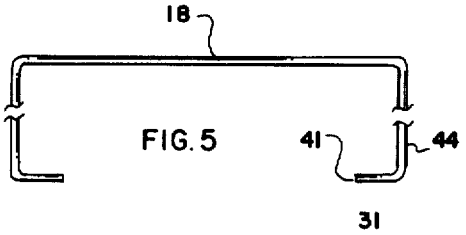
FIG. 5 is a front view of the bail.
Figure 9:
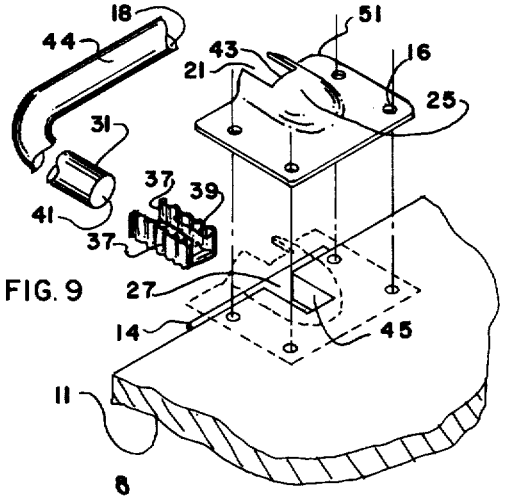
FIG. 9 is an exploded perspective detail view of the invention as seen from the rear side of the board.
Figure 6:
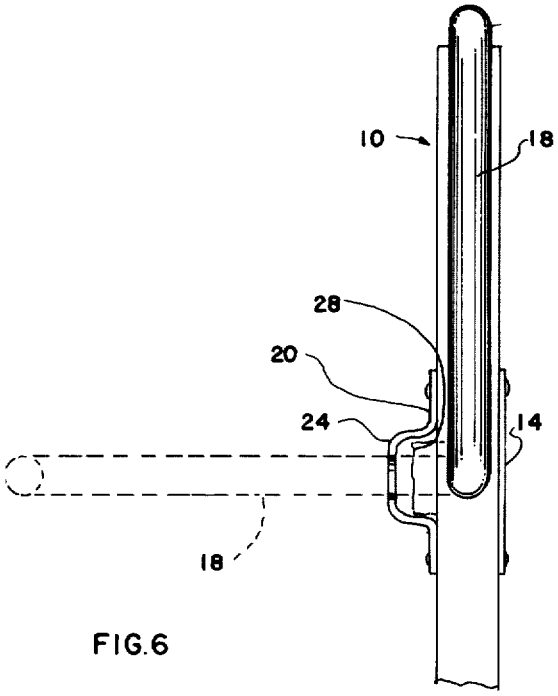
FIG. 6 is a detail side view of the board showing the connection of the ball to the board in detail.
Figure 7:
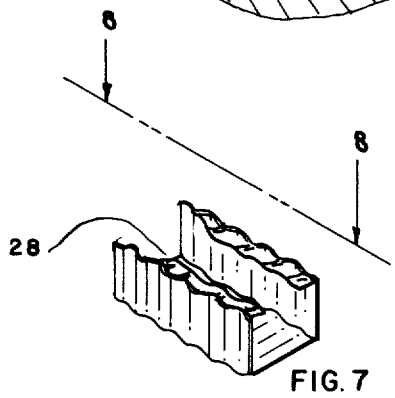
FIG. 7 is a perspective side view of the corrugated spring metal bushing.
Figure 8:
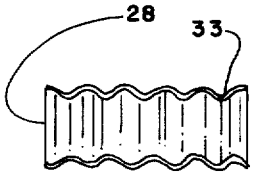
FIG. 8 is a cross-section of FIG. 7 taken along line 8—8 of FIG. 7.

However, the bail is formed of a size so that in the normal closed position, shown in FIG. 4, the sides 44 of the bail fit snugly against the respective sides 23 of the board. In the fully opened position, shown in FIG. 1, a portion of each bail side 44 extends into plate slot 21 to latch the bail into the open position, as shown by dash lines in FIG. 6. The bail side sections 44 must be manually sprung apart to release the bail from this latched open position. The upper outermost corner 51, 53 of each plate 20, 11 respectively is rounded to enable the bail to be readily pivoted from the closed position to a partial or fully opened position as each bail side 44 rides on a corner 51 or 53 to spring sides 44 apart. The projecting portion of plates 14 and 20 serve to positively latch the bail in the closed position of FIG. 4.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A portable board fitted with means to a be mounted so as to lie at an inclined angle to a horizontal surface, on which it rests, said means comprising a bail mounted by pivotal means to the board, together with:

first latch means to positively latch the bail in a first closed position, in which the bail lies substantially in the plane of the board, and together with second latch means to positively latch the bail in an open position, in which the first latch means comprise a pair of plates that extend from opposite faces of the board beyond an edge of the board, with the said plates spaced apart by the general thickness of the bail, which bail may fit between the extended sections of said plates, in which the second latch means comprises a slot in one of said plates, which slot extends from a side of the board to the side of an extended portion of the plate, said slot of a size to enable a side of the bail to rest in said slot.

* * * * *